US010233408B2

(12) United States Patent
Valdepena et al.

(10) Patent No.: US 10,233,408 B2
(45) Date of Patent: Mar. 19, 2019

(54) FABRIC SOFTENING COMPOSITIONS

(71) Applicant: Colgate-Palmolive Company, New York, NY (US)

(72) Inventors: Israel Hernandez Valdepena, Mexico City (MX); Raul Arellano Maldonado, Mexico City (MX); Edna Ambundo, Cranbury, NJ (US); Jose Javier Tovar Pescador, Mexico City (MX)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 16/065,376

(22) PCT Filed: Dec. 28, 2015

(86) PCT No.: PCT/US2015/067690
§ 371 (c)(1),
(2) Date: Jun. 22, 2018

(87) PCT Pub. No.: WO2017/116398
PCT Pub. Date: Jul. 6, 2017

(65) Prior Publication Data

US 2019/0002798 A1 Jan. 3, 2019

(51) Int. Cl.

| | |
|---|---|
| ***C11D 3/50*** | (2006.01) |
| ***C11D 3/00*** | (2006.01) |
| ***C11D 1/62*** | (2006.01) |
| ***C11D 3/384*** | (2006.01) |
| ***C11D 3/37*** | (2006.01) |
| ***C11D 3/20*** | (2006.01) |

(52) U.S. Cl.
CPC ..... *C11D 3/001* (2013.01); *C11D 1/62* (2013.01); *C11D 3/2017* (2013.01); *C11D 3/2093* (2013.01); *C11D 3/373* (2013.01); *C11D 3/3734* (2013.01); *C11D 3/3742* (2013.01); *C11D 3/384* (2013.01)

(58) Field of Classification Search
CPC ..... C11D 3/001; C11D 3/0015
See application file for complete search history.

(56) References Cited

U.S. PATENT DOCUMENTS

| | | | | |
|---|---|---|---|---|
| 4,627,925 | A | 12/1986 | Butterworth et al. | |
| 4,789,491 | A | 12/1988 | Chang et al. | |
| 6,432,895 | B1 | 8/2002 | Bigorra et al. | |
| 6,492,315 | B1 | 12/2002 | Cao et al. | |
| 6,605,581 | B1 | 8/2003 | Cao et al. | |
| 8,242,071 | B2 | 8/2012 | Henault et al. | |
| 8,253,543 | B2 | 8/2012 | Yamamoto | |
| 2007/0054835 | A1* | 3/2007 | Corona, III | C11D 1/62 510/515 |
| 2007/0207942 | A1 | 9/2007 | Creutz et al. | |
| 2009/0111728 | A1* | 4/2009 | De Block | C11D 1/62 510/526 |

FOREIGN PATENT DOCUMENTS

| | | |
|---|---|---|
| EP | 0018039 | 10/1980 |
| EP | 1279726 | 1/2003 |
| WO | 2004/011589 | 2/2004 |
| WO | 2008/003454 | 1/2008 |

OTHER PUBLICATIONS

International Search Report and Written Opinion of the International Searching Authority in International Application No. PCT/US2015/067690, dated Jul. 25, 2016.

* cited by examiner

*Primary Examiner* — John R Hardee

(57) ABSTRACT

Described herein are fabric softening compositions comprising a quaternary ammonium compound, an edible-type tallow, isopropyl alcohol, and a plasticizer comprising an iso-methyl group. Methods of making and using the fabric softening compositions are also described herein.

14 Claims, No Drawings

FABRIC SOFTENING COMPOSITIONS

BACKGROUND

Conventional fabric softener compositions are added to the washing, rinsing, or drying step of the laundry cycle to, for example, soften the laundry and reduce static. Such fabric softeners are often formed of a blend of quaternary ammonium compounds (e.g., salts) or imidazolinium compounds having at least one long chain hydrocarbyl group, isopropyl alcohol (IPA), and additives designed to optimize the properties of the resulting composition. Quaternary ammonium compounds are known to exhibit particularly good fabric softening performance, and IPA is commonly used to decrease the melting temperature of the quaternary ammonium compound in order to improve manufacturing and handling of the resulting fabric softener composition. IPA also functions as a vehicle to make a spontaneous emulsion during the manufacture of the fabric softener composition, thus further improving manufacturing efficiency.

The use of IPA in its standard amount, however, is undesirable from a cost standpoint and also because it is limited in its function (providing no additional benefit to the fabric softening composition other than that discussed above). As such, fabric softener compositions that partially or completely replace IPA with multifunctional materials are desired. Fabric softening compositions with improved performance, i.e., softness, are also desired.

BRIEF SUMMARY

Accordingly, one aspect of the invention is directed to fabric softener compositions including quaternary ammonium compounds (for their fabric softening properties) and relatively low amounts of IPA. In some embodiments, plasticizers and/or tallow are incorporated into the compositions to decrease the amount of IPA used, while still retaining the function of decreasing the melting temperature of the quaternary ammonium compound. These materials are less expensive than IPA and are multifunctional in that they also improve softening performance.

In one aspect, the invention provides a fabric softening composition which includes from about 80 wt. % to about 95 wt. % of a quaternary ammonium compound, from about 1 wt. % to about 10 wt. % tallow, from about 0.5 wt. % to about 5 wt. % isopropyl alcohol, and a plasticizer comprising an iso-methyl group.

The invention further provides a method of forming a fabric softening composition, comprising the steps of heating a dialkyl ester of triethanol ammonium methyl sulphate to approximately 70-85° C., heating an edible-type tallow to about 40-50° C., mixing the edible-type tallow and dialkyl ester of triethanol ammonium methyl sulphate to form a first mixture, adding at least one plasticizer and isopropyl alcohol to the first mixture and stirring until homogeneous to form a second mixture, and heating the second mixture to about 50-60° C. and maintaining the second mixture at that temperature for about one day.

DETAILED DESCRIPTION

In some embodiments, the present invention provides a fabric softening composition, comprising: from about 80 wt. % to about 95 wt. % of a quaternary ammonium compound; from about 1 wt. % to about 10 wt. % tallow; from about 0.5 wt. % to about 5 wt. % isopropyl alcohol; and a plasticizer comprising an iso-methyl group.

In some embodiments, the quaternary ammonium compound comprises a dialkyl ester of triethanol ammonium methyl sulfate. In some embodiments, the fabric softening composition comprises from about 85 wt. % to about 90 wt. % of the quaternary ammonium compound.

In other embodiments, the composition comprises about 88 wt. % of a quaternary ammonium compound.

In some embodiments, the composition comprises from about 2.5 wt. % to about 7.5 wt. % tallow. Further embodiments provide compositions comprising from about about 5 wt. % to about 7 wt. % tallow. Yet other embodiments provide compositions comprising about 6.5 wt. % tallow.

In some embodiments, the fabric softening composition comprises about 2 wt. % or less of isopropyl alcohol.

Some embodiments of the present invention provide compositions comprising from about 0.5 wt. % to about 5 wt. % of a plasticizer comprising an iso-methyl group. In some embodiments, the plasticizer is selected from an ethylhexyl isononanoate compound, silicone, a decamethylcyclopentasiloxane compound, iso-methyl ethoxylated alcohol, isopropyl myristate, isopropyl palmitate, isodecyl neopentanoate, isodecyl oleate, diisopropyl adipate, and a combination of two or more thereof. In some embodiments, the iso-methyl ethoxylated alcohol comprises isodecyl alcohol. In other embodiments, the plasticizer comprises isodecyl alcohol and isopropyl palmitate. Further embodiments provide fabric softening compositions wherein the plasticizer comprises isodecyl alcohol and ethylhexyl isononanoate.

Some embodiments provide a method of preparing a fabric softening composition, comprising the steps of: heating a dialkyl ester of triethanol ammonium methyl sulphate to approximately 70-85° C.; heating an edible-type tallow to about 40-50° C.; mixing the edible-type tallow and dialkyl ester of triethanol ammonium methyl sulphate to form a first mixture; adding at least one plasticizer and isopropyl alcohol to the first mixture and stirring until homogeneous to form a second mixture; and heating the second mixture to about 50-60° C. and maintaining the second mixture at that temperature for about one day.

In some embodiments, the fabric softener (FS) compositions of the present invention comprise at least one quaternary ammonium compound, tallow, isopropyl alcohol (IPA), and at least one plasticizer. In some embodiments, these compositions include a relatively low amount of IPA as compared to conventional FS compositions. In some embodiments, the reduced concentration of IPA decreases manufacturing costs while retaining good handling during manufacturing. Some embodiments, also provide compositions that exhibit increased softening properties.

In some embodiments, the quaternary ammonium compound comprises a biodegradable fatty acid quaternary ammonium compound known as an esterquat. In some embodiments, the quaternary ammonium compound imparts fabric softening properties to the FS composition.

In some embodiments, the quaternary ammonium compound is derived from the reaction of an alkanol amine and a fatty acid derivative, followed by quaternization (complete or partial) of the product. In some embodiments, the quaternary ammonium compound is a dialkyl ester of triethanol ammonium methyl sulphate. In some embodiments, the quaternary ammonium compound comprises a compound having the structure of formula I:

I

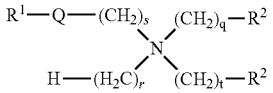

wherein:

Q is a carboxyl group having the structure selected from —OCO—; and —COO;

$R^1$ is an aliphatic hydrocarbon group having from 8 to 22 carbon atoms, preferably a $C_{10}$ to $C_{20}$ alkyl group;

$R^2$ is selected from Q-$R^1$ and —OH;

q, r, s, t each independently represent a number from 1 to 3; and $X^{-a}$ is an anion having a valence "a". Preferred anion materials include chloride, bromide, and methyl sulfate.

In some embodiments, the present invention provides a quaternary ammonium compound of formula I, wherein one of the $R^2$ groups is Q-$R^1$. Further embodiments provide a quaternary ammonium compound of formula I, wherein both $R^2$ groups are Q-$R^1$. Still further embodiments provide a quaternary compound of formula I, wherein both $R^2$ groups are —OH.

In some embodiments, the quaternary ammonium compound comprises a mixture of monoesters, diesters, and triesters. In some embodiments, the normalized percentage of monoester compound in said quaternary ammonium compound is from 28% to 34%; the normalized percentage of diester compound is from 55% to 62%, and the normalized percentage of triester compound is from 8% to 14%, all percentages being by weight.

In some embodiments, the quaternary ammonium compound is an oligomeric esterquat, obtainable by reaction of an alkanol amine with (i) a polycarboxylic acid; and (ii) a fatty alcohol or a fatty acid or a mixture of fatty alcohols and fatty acids, followed by partial quaternization, thereby forming a mixture of oligomeric ester amines and esterquat. In some embodiments, the alkanol amine is triethanol amine. In some embodiments, the carboxylic acid is a polycarboxylic acid. In other embodiments the carboxylic acid is a dicarboxylic acid. An example of such an esterquat material is the esterquats commercially available from Kao Chemicals or Stepan Company.

In some embodiments, the compositions of the present invention are water dispersions, such that the bulk of the balance of the composition is water. In some embodiments, the composition is acidic, having a pH of about 2 to about 6. Materials, such as acids or acid salts, can be added to the composition to control the pH of the composition. An example of a material that can be added is lactic acid. It is the acidity of the composition which makes it particularly important to stabilize the esterquat material.

Optional ingredients that are known in the art of treating textiles can be used to further improve the stability, the aesthetics, or the performance of the compositions of the present invention.

In some embodiments, a perfume may be added to enhance the freshness of the laundered clothing (or just to enhance the aesthetics of the composition itself). In some embodiments, the compositions of the present invention may contain a fatty alcohol ethoxylate nonionic surfactant to emulsify the perfume present in the composition. In some embodiments, the presence of an emulsifier ensures the physical stability of the composition which may otherwise be destabilized by the presence of perfume or fragrance. The fatty alcohol ethoxylates useful in the invention correspond to ethylene oxide condensation products of higher fatty alcohols, with the higher fatty alcohol containing about 9 to about 15 carbon atoms and the number of ethylene oxide groups per mole being about 5 to about 30.

As used herein, the term "perfume" is used in its ordinary sense to refer to and include any non-water soluble substance or a mixture of substances, including natural (i.e., obtained by extraction of flowers, herbs, blossoms, or plants), artificial (i.e., mixtures of natural oils or oil constituents), and synthetically produced odoriferous substances. Typically, perfumes are complex mixtures or blends of various organic compounds, such as alcohols, aldehydes, ethers, aromatic compounds, and varying amounts of essential oils (e.g., terpines), the essential oils themselves being volatile, odoriferous compounds, and also serving to dissolve the other components of the perfume.

In some embodiments, compositions of the present invention may contain a polyethylene glycol polymer or a polyethylene glycol alkyl ether polymer. In some embodiments, the polyethylene glycol polymer or polyethylene glycol alkyl ether polymer prevents gelation of the composition. The polyethylene glycol polymers as used herein, have a molecular weight of at least about 200, up to a molecular weight of about 8,000. Useful polymers include, but are not limited to, the polyethylene glycol methyl ether polymers marketed by Aldrich Chemical Company. Useful amounts of polymer in the compositions range from about 0.1% to about 5% by weight. A range about 0.5% to about 1.5% by weight is preferred.

Examples of optional rheology modifiers and thickeners for use herein are well known in the art, and may be chosen from polymeric rheology modifiers and inorganic rheology modifiers. Examples of the former type include cationic polymers, such as copolymers of acrylamide and quaternary ammonium acrylate, and the like. Generally, only minor amounts, up to about 1%, preferably up to about 0.8%, such as, for example, about 0.1% to about 0.6%, by weight, provide acceptable viscosity levels over time.

Other optional co-softeners for use in the present invention are, for example, fatty alcohols, glycerol monostearate (GMS) and glycerol mono-oleate (GMO).

Other optional ingredients which may be used to reduce fabric wrinkling and enhance ease of ironing are nonionic humectants, inorganic salts, and film-forming polymeric materials, such as polyacrylates, polymethacrylates, silicones, starch derivatives, and poly olefin waxes.

Anti-dye transfer polymeric materials, such as polyvinyl pyrrolidone-type compounds may also be added to the present compositions.

Sequestering materials, such as polyphosphonates and polycarboxylic materials, can be used to neutralize water impurities, such as minerals (calcium, magnesium, copper), to protect the color of the clothes being laundered.

Other optional components commonly used in fabric softening compositions may be added in minor amounts to enhance either the appearance or performance properties of the liquid textile treating (fabric softener) compositions of the present invention. Typical components of this type include, but are not limited to, colorants (e.g., dyes or pigments), bluing agents, preservatives, germicides and perfumes.

The final product, whether in concentrated or diluted form, must be easily pourable by the end user. Generally, therefore, the final product viscosity (for a freshly prepared sample) should not exceed about 1500 centipoise, but should not be too low, for example, not less than about 50 centipoise. In some embodiments, viscosity is measured at 25° C. (22-26° C.) using a Brookfield RVTD digital viscometer with spindle #2 at 50 rpm.

In some embodiments, the compositions of the present invention may be diluted by a factor of 4:1, optionally about 8:1, further optionally 10:1.

In some embodiments, the compositions of the present invention remain pourable and stable against phase separation or suspended particle agglomeration for extended periods of time. After dilution, or for a ready-to-use product, the composition will normally contain sufficient softener to be effective when added to the rinse water in an amount of about ⅛ to ¾ of a cup (1 to 6 ounces), providing about 50 ppm to about 250 ppm of the softener in the rinse water. Where the compositions are used in the textile manufacturing process, they are typically formulated at about 50 to about 250 ppm in an aqueous solution and applied (e.g., padded onto) the finished fabric, and dried.

The compositions of the present invention are able to provide additional benefits beyond fabric softening to fabrics and laundry, which are conditioned with such compositions. Principally, it is noted that these compositions can provide improved color protection by dye transfer inhibition to treated fabrics, as well as improved care benefits by minimizing fabric abrasion. This has the effect of enhancing fabric appearance and extending fabric longevity.

The compositions of the present invention are made by any means known or to be developed in the art.

In some embodiments, the compositions further comprise edible-type tallow. Tallow is a rendered form of beef or mutton fat, processed from suet. Tallow is an inexpensive material and is highly compatible for use with EsQ, as it is actually used as a source for producing EsQ in industry. In some embodiments, the composition preferably comprises about 1-15 wt % tallow, optionally about 5-15 wt % tallow, further optionally about 5-10 wt % tallow, based upon the total weight of the composition. By incorporating tallow into the composition, the overall amount of IPA may be reduced in the composition, as discussed below.

In some embodiments, the composition further comprises IPA. In some embodiments, IPA functions to decrease the melting point of the quaternary ammonium compound, thereby increasing the processing capabilities of the resulting composition and improving manufacturing efficiency. Moreover, IPA is useful as a vehicle to allow a spontaneous emulsion to form during manufacture, thus improving production, transportation, and storage efficiency. However, IPA is an expensive chemical and compositions with reduced amounts of IPA are preferred. As such, the composition preferably comprises 1-5 wt % IPA, optionally 1-3 wt % IPA, further optionally 2 wt % or less of IPA, based upon the total weight of the composition. Conventional compositions comprise as much as 10 wt % IPA in the final blend. In some embodiments, the compositions of the present invention are free of IPA, i.e., it contains less than about 0.01 wt % of IPA.

In some embodiments, the composition further comprises at least one plasticizer. In some embodiments, the composition comprises about 1-10 wt % of plasticizer, optionally about 1-5 wt %, further optionally about 1-4 wt %, based upon the total weight of the composition.

In some embodiments, the plasticizer comprises at least one of an ethylhexyl isononanoate compound (such as that commercially available under the brand name Dragoxat® from Symrise AG (Holzminden, Germany)), silicone, paraffin, a decamethylcyclopentasiloxane compound (such as Cyclomethicone commercially available from Dow Corning Corp. (Midland, Mich.)), and iso-methyl ethoxylated alcohols (IM EO alcohols). Suitable IM EO alcohols include, but are not limited to, isodecyl alcohols such as those commercially available under the brand names Makon® DA6 and Makon® DA9 from the Stepan Company of Northfield, Ill. The difference between Makon® DA6 and Makon® DA9 is that the former has 6 EO moles in the alcohol molecule, while the latter has 9 EO moles. In some embodiments the compositions of the present invention comprise Makon® DA6.

In some embodiments, an ethylhexyl isononanoate is used as the plasticizer, as it is shown to have a chemical structure very similar to that of IPA. Without being bound by theory, it is believed that the iso-methyl group present in ethylhexyl isononanoate and IPA is the primary component which helps to reduce the melting temperature of the quaternary ammonium compound. Compounds with similar chemical structures to that of ethylhexyl isononanoate that may also be used as the plasticizer include, but are not limited to, isopropyl myristate, isopropyl palmitate, isodecyl neopentanoate (such as that commercially available under the brand name Schercemol™ 105 Ester from The Lubrizol Corp. (Wickliffe, Ohio)), isodecyl oleate, and diisopropyl adipate (such as that commercially available under the brand name Schercemol™ DIA Ester from The Lubrizol Corp. (Wickliffe, Ohio)). Each of these are shown to exhibit similar rheological properties as ethylhexyl isononanoate when used together with a quaternary ammonium compound as described herein.

In other embodiments, an IM EO alcohol is used as the plasticizer. In addition to the benefit of reducing the melting temperature and improving softness of the compositions described herein, it is shown that IM EO alcohols also function as free-rinse agents. Without being bound by theory, it is believed that the presence of the iso-methyl group in the IM EO alcohol helps it to reduce the melting temperature of the quaternary ammonium compounds described herein.

In some embodiments, compositions of the present invention comprises at least two plasticizers. In some embodiments, the present invention provides a composition comprising a combination of isodecyl alcohol and one of isopropyl palmitate or ethylhexyl isononanoate.

Suitable plasticizers may be provided in the form of a solid, a liquid, or an emulsion depending on the particular parameters of the application. Like tallow, the plasticizer component functions to decrease the melting temperature of the composition. Specifically, it is believed that when incorporated into the EsQ-tallow blend, the plasticizers embed themselves between the polymer EsQ chains of the remaining components, spacing them apart and increasing the free volume of the mixture, thus lowering the temperature at which the polymer EsQ chains start to move. Based upon this principle, the plasticizers reduce the melting temperature of the resulting EsQ blend, thus allowing for a reduction in the amount of IPA. Plasticizers are further shown to improve the softness properties of the FS composition.

To form an FS composition according to some embodiments of the present invention, the quaternary ammonium compound, e.g., EsQ, is first heated to about 70-85° C. in an oven. In some embodiments, the tallow is separately heated to about 40-50° C. Each of these components is then mixed together to form a first mixture. To that mixture, the plasticizer and isopropyl alcohol are added in desired amounts and the resulting mixture is stirred until it reaches a homogeneous consistency. That final mixture is then heated to about 50-60° C. in an oven for about one day until the fabric softening composition is formed to have a consistent and uniform mixture.

In some embodiments, the present invention provides methods of softening a fabric comprising applying an effective amount of a composition as described herein to a fabric. In some embodiments, the method further comprises the step of rising the fabric to which the composition is applied.

The invention will now be described in conjunction with the following, non-limiting examples.

EXAMPLES

Example 1

To initially determine the mixing compatibility of EsQ with various plasticizers, blends of EsQ and the plasticizers set forth in Table 1 (below) are prepared. The blends contain a 90:10 ratio (by weight) of EsQ:plasticizer.

TABLE 1

| | Plasticizer |
|---|---|
| A | Refined Paraffin 130 |
| B | Ethylhexyl Isononanoate |
| C | Dimethyl Polysiloxane |
| D | Dimethyl Polysiloxane |
| E | Stearyl Dimethicone PG-Diethymonium Chloride |
| F | Dimethicone Copolyol PEG/PPG-18/18 Dimethicone |
| G | Cyclomethicone (Decamethylcyclopentasiloxane) |
| H | Aminosilicone emulsion |

Each of the eight (8) exemplary EsQ+plasticizer blends is prepared by heating a designated amount of EsQ (having no solvent) to approximately 70-85° C. About 90 grams is weighed and placed into a 125 mL HDPE bottle and stirred. To this, about 10 grams of each of the plasticizers set forth in Table 1 are added and stirred until the components are sufficiently mixed and reach a homogenous consistency. The samples are then covered and placed into an oven at 55° C., where they were kept for one day. An initial assessment indicated that only certain plasticizers exhibited good compatibility, namely, Blends A, B and G.

Based on this initial assessment, a flow test was performed on Blends A, B, G to determine whether each of the plasticizers was compatible with EsQ and whether it assisted in decreasing the EsQ melting temperature. The flow test was performed using an AR2000 rheometer with a 40 mm cone-plate system available from TA Instruments, Inc. of Dallas, Tex. at a temperature ramp of 50-80° C. and a shear stress of 4 Pa. The results of the flow test are set forth in Table 2 (below). Each of the tested blends is compared to two control FS compositions having no plasticizer components. Control 1 was a blend of 90% EsQ and 10% IPA (current conventional FS composition available commercially), and Control 2 was a blend of 90% EsQ, 6.5% tallow, and 3.5% IPA.

TABLE 2

| Blend | Temperature | Viscosity (Pa · s) |
|---|---|---|
| Control 1 | 52.3 | 0.6406 |
| | 55.4 | 0.4892 |
| | 58.5 | 0.3372 |

TABLE 2-continued

| Blend | Temperature | Viscosity (Pa · s) |
|---|---|---|
| | 61.6 | 0.2472 |
| | 64.7 | 0.1977 |
| | 67.8 | 0.1634 |
| | 70.8 | 0.1399 |
| | 73.8 | 0.12 |
| | 76.8 | 0.1048 |
| | 79.8 | 0.09466 |
| Control 2 | 53.8 | 1.509 |
| | 59.1 | 0.9964 |
| | 64.3 | 0.6257 |
| | 69.4 | 0.4216 |
| | 74.6 | 0.2748 |
| | 79.6 | 0.1818 |
| Blend A | 53.9 | 86.99 |
| | 59.1 | 25.66 |
| | 64.2 | 17.85 |
| | 69.4 | 13.77 |
| | 74.6 | 9.489 |
| | 79.7 | 5.769 |
| Blend B | 53.8 | 13.37 |
| | 59 | 9.419 |
| | 64.3 | 6.708 |
| | 69.4 | 4.416 |
| | 74.7 | 2.428 |
| | 79.7 | 1.332 |
| Blend G | 53.9 | 74.81 |
| | 59.2 | 49.49 |
| | 64.3 | 37.09 |
| | 69.4 | 25.09 |
| | 74.5 | 15.7 |
| | 79.6 | 8.261 |

This initial evaluation revealed that the Blends A, B, and G all exhibited flow behavior very similar to that of each of the control compositions. The ethylhexyl isononanoate plasticizer (Dragoxat®, Blend B) exhibited rheological characteristics most closely aligned with the controls. Specifically, the data described in Table 2 (above) demonstrates that these plasticizers are unexpectedly compatible with EsQ and do not adversely impact flowability.

Example 2

Seven exemplary FS compositions are prepared with a combination of EsQ, tallow, plasticizer, and IPA as set forth in Table 3 (below).

TABLE 3

| | # 1 | # 2 | # 3 | # 4 | # 5 | # 6 | # 7 |
|---|---|---|---|---|---|---|---|
| EsQ | 85 | 88 | 85 | 85 | 88 | 88 | 88 |
| Tallow | 10 | 6.5 | 10 | 10 | 6.5 | 6.5 | 6.5 |
| IPA | 2 | 2 | 2 | 2 | 2 | 2 | 2 |
| Isopropyl myristate (plasticizer) | — | — | 3 | — | — | — | — |
| Isopropyl palmitate (plasticizer) | — | — | — | 3 | — | — | — |
| Ethylhexyl isononanoate (Dragoxat ®, plasticizer) | 3 | 3.5 | — | — | — | — | — |
| Isodecyl oleate (plasticizer) | — | — | — | — | 3.5 | — | — |
| Isodecyl neopentanoate (plasticizer) | — | — | — | — | — | — | 3.5 |
| Diisopropyl adipate (plasticizer) | — | — | — | — | — | 3.5 | — |

Each of the exemplary FS compositions is prepared by first heating EsQ (without solvent) to approximately 70-85° C. The EsQ is then weighed, according to the amounts in Table 2 (above), and added to an empty 125 mL HDPE bottle. The tallow is then separately heated to about 45° C.

and weighed, according to the amounts in Table 2 (above), and added to the HDPE bottle.

The plasticizer is added to the EsQ/tallow blend, and then the IPA is added. Each resulting mixture is stirred until all ingredients are sufficiently mixed and reach a homogenous consistency. The samples are covered and placed into an oven at 55° C. and maintained at that temperature for one day before a flow test is conducted. The flow test is performed using the same equipment and procedure as set forth in Example 1 (above). The flow test results are set forth in Table 4 (below).

TABLE 4

| Blend | Temperature | Viscosity (Pa · s) |
|---|---|---|
| Ex. 1 | 56 | 78.28 |
| | 58.3 | 13.32 |
| | 60.6 | 8.954 |
| | 62.6 | 7.386 |
| | 64.8 | 6.349 |
| | 67 | 5.306 |
| | 69.2 | 4.32 |
| | 71.3 | 3.224 |
| | 73.5 | 1.937 |
| | 75.6 | 1.059 |
| | 77.7 | 0.69 |
| | 79.9 | 0.5215 |
| Ex. 2 | 51.6 | 196.7 |
| | 53.8 | 53.84 |
| | 56.1 | 24.96 |
| | 58.3 | 14.58 |
| | 60.5 | 10.99 |
| | 62.7 | 8.889 |
| | 64.8 | 7.462 |
| | 67 | 6.305 |
| | 69.1 | 5.306 |
| | 71.3 | 4.158 |
| | 73.4 | 2.783 |
| | 75.6 | 1.419 |
| | 77.7 | 0.9296 |
| | 79.9 | 0.6756 |
| Ex. 3 | 54 | 2.075 |
| | 59.2 | 1.666 |
| | 64.4 | 1.299 |
| | 69.6 | 1.046 |
| | 74.5 | 0.874 |
| | 79.6 | 0.7239 |
| Ex. 4 | 54 | 1.99 |
| | 59 | 1.617 |
| | 64.3 | 1.305 |
| | 69.4 | 1.076 |
| | 74.5 | 0.8856 |
| | 79.6 | 0.7314 |
| Ex. 5 | 59.2 | 11.43 |
| | 64.3 | 7.379 |
| | 69.5 | 5.737 |
| | 74.6 | 4.121 |
| | 79.6 | 2.579 |
| Ex. 6 | 54 | 6.388 |
| | 59.3 | 4.335 |
| | 64.3 | 3.155 |
| | 69.5 | 2.227 |
| | 74.6 | 1.314 |
| | 79.7 | 0.6619 |
| Ex. 7 | 53.9 | 7.472 |
| | 59.1 | 5.625 |
| | 64.2 | 4.414 |
| | 69.4 | 3.402 |
| | 74.5 | 2.41 |
| | 79.7 | 1.097 |

As can be seen in Table 4, at a temperature range between 60 and 70° C., the rheological profiles of Examples 3 and 4 most closely align with that of Control 2 from Example 1. With respect to Examples 5-7, similar rheological behavior was exhibited by all iso-methyl-containing plasticizers.

Examples 1-4 are then subjected to a panel softness evaluation. Softness of two groups of Terry towels (100% cotton) is evaluated according to a defined statistical model. According to this model, treated towels are presented to a group of untrained panelists, who select the towels that they perceive as being softest. The statistic model also takes into account whether the perception is significantly different between the two groups of towels presented, one treated with Examples 1-4, and the other treated with Control 1 from Example 1. As can be seen in Table 5 (below), all samples provide at least equivalent softness as Control 1, which is acceptable in the industry.

TABLE 5

| Example | Softness | |
|---|---|---|
| Control | A | b |
| 1 | | b |
| 2 | A | |
| 3 | | b |
| 4 | A | b |

Example 3

Two additional exemplary FS compositions are prepared with a combination of EsQ, tallow, IM EO alcohol-containing plasticizer, and IPA as set forth in Table 6 (below).

TABLE 6

| | # 8 | # 9 |
|---|---|---|
| EsQ | 88 | 88 |
| Tallow | 6.5 | 6.5 |
| IPA | 2 | 2 |
| Isodecyl alcohol (Makon ® DA6, plasticizer) | — | 3.5 |
| Isodecyl alcohol (Makon ® DA9, plasticizer) | 3.5 | — |

Each of the exemplary FS compositions are prepared according to the parameters set forth in Example 2 (above), and a flow test is then conducted. The results are set forth in Table 7 (below). As can be seen, Example 9 (having the Makon® DA6 plasticizer) exhibited the closest rheological behavior to that of Control 2 from Example 1 (above).

TABLE 7

| Blend | Temperature | Viscosity (Pa · s) |
|---|---|---|
| Ex. 8 | 54 | 11.35 |
| | 59.1 | 7.636 |
| | 64.3 | 5.441 |
| | 69.5 | 3.949 |
| | 74.6 | 2.535 |
| | 79.7 | 1.222 |
| Ex. 9 | 54 | 7.866 |
| | 59.2 | 5.436 |
| | 64.3 | 4.001 |
| | 69.5 | 2.893 |
| | 74.6 | 1.808 |
| | 79.7 | 0.9188 |

Example 4

Five additional exemplary FS compositions are prepared to determine the effect of modifying the amounts of each component, and to determine the effect of including a combination of plasticizers, as set forth in Table 8 (below).

TABLE 8

| | # 10 | # 11 | # 12 | # 13 | # 14 |
|---|---|---|---|---|---|
| EsQ | 88 | 90 | 88 | 88 | 88 |
| Tallow | 6.5 | 5.5 | 7.5 | 5 | 5.5 |
| IPA | 2 | 2 | 2 | 2 | 2 |
| Isodecyl alcohol (Makon ® DA6, plasticizer) | 3.5 | 2.5 | 2.5 | 2.5 | 2.5 |
| Isopropyl palmitate (plasticizer) | — | — | — | 2.5 | — |
| Ethylhexyl isononanoate (Dragoxat ®, plasticizer) | — | — | — | — | 2 |

Each of the exemplary FS compositions is prepared according to the parameters set forth in Example 2, and a flow test is then conducted. The results are set forth in Table 9 (below). Examples 13 and 14, which included a blend of two plasticizers, exhibited rheological behavior that was closest to the rheological behavior of Control 2 from Example 1. However, it must be noted that all blends exhibited acceptable rheological behavior according to industry standards.

TABLE 9

| Blend | Temperature | Viscosity (Pa · s) |
|---|---|---|
| Ex. 10 | 54 | 7.866 |
| | 59.2 | 5.436 |
| | 64.3 | 4.001 |
| | 69.5 | 2.893 |
| | 74.6 | 1.808 |
| | 79.7 | 0.9188 |
| Ex. 11 | 53.9 | 25.79 |
| | 59.2 | 12.98 |
| | 64.3 | 9.331 |
| | 69.5 | 6.847 |
| | 74.6 | 4.788 |
| | 79.7 | 2.934 |
| Ex. 12 | 54 | 8.142 |
| | 59.1 | 5.724 |
| | 64.3 | 4.343 |
| | 69.6 | 3.284 |
| | 74.5 | 2.349 |
| | 79.7 | 1.505 |
| Ex. 13 | 54 | 6.68 |
| | 59.1 | 4.5 |
| | 64.2 | 3.157 |
| | 69.4 | 2.233 |
| | 74.4 | 1.348 |
| | 79.5 | 0.7465 |
| Ex. 14 | 53.9 | 6.583 |
| | 59.2 | 4.447 |
| | 64.3 | 3.119 |
| | 69.4 | 2.234 |
| | 74.6 | 1.447 |
| | 79.5 | 0.8086 |

Examples 10-14 are then subjected to a panel softness evaluation according to the same parameters of Example 1, with the Control provided being a commercially available FS composition. As set forth in Table 10 (below), all of the exemplary compositions of the present invention exhibit generally the same degree of softness, which is acceptable in the industry. Example 14 exhibited the highest relative softness as compared to the other examples.

TABLE 10

| Product | Softness |
|---|---|
| Control | a |
| Ex. 10 | a |
| Ex. 11 | a |
| Ex. 12 | a |

TABLE 10-continued

| Product | Softness |
|---|---|
| Ex. 13 | a |
| Ex. 14 | a |

Example 5

A residue test was also conducted on Examples 8-14 to determine their rinse-aid effectiveness (i.e., whether any residue is left on the treated fabric). Two factors are visually analyzed in a residue test: (1) the amount of residue that remains on the surface of a black, fabric swatch after the rinsing step, and (2) the amount of foam generated. Residue is a precipitation formation (i.e., scum) originated by the residual detergent and the fabric softener during the washing and rinsing cycles. All of the exemplary FS compositions exhibit good rinse-aid properties. It is believed that the presence of the IM EO alcohol helps to dissolve the white precipitate formed and eliminate its presence on the surface of the fabric swatch.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A fabric softening composition, comprising:

from about 80 wt. % to about 95 wt. % of a quaternary ammonium compound;

from about 1 wt. % to about 10 wt. % tallow;

from about 0.5 wt. % to about 5 wt. % isopropyl alcohol; and a plasticizer comprising a compound having an iso-methyl group.

2. The fabric softening composition according to claim 1, wherein the quaternary ammonium compound comprises a dialkyl ester of triethanol ammonium methyl sulphate.

3. The fabric softening composition according to claim 1, comprising from about 85 wt. % to about 90 wt. % of the quaternary ammonium compound.

4. The fabric softening composition according to claim 1, comprising about 88 wt. % of the quaternary ammonium compound.

5. The fabric softening composition according to claim 1, comprising from about 2.5 wt. % to about 7.5 wt. % tallow.

6. The fabric softening composition according to claim 1, comprising from about 5 wt. % to about 7 wt. % tallow.

7. The fabric softening composition according to claim 1, comprising about 6.5 wt. % tallow.

8. The fabric softening composition according to claim 1, comprising about 2 wt. % or less of isopropyl alcohol.

9. The fabric softening composition according to claim 1, comprising from about 0.5 wt. % to about 5 wt. % of a plasticizer comprising an iso-methyl group.

10. The fabric softening composition according to claim 1, wherein the plasticizer is selected from an ethylhexyl isononanoate compound, silicone, a decamethylcyclopentasiloxane compound, iso-methyl ethoxylated alcohol, isopropyl myristate, isopropyl palmitate, isodecyl neopentanoate, isodecyl oleate, diisopropyl adipate, and a combination of two or more thereof.

11. The fabric softening composition according to claim 10, wherein the iso-methyl ethoxylated alcohol comprises isodecyl alcohol.

12. The fabric softening composition according to claim 1, wherein the plasticizer comprises isodecyl alcohol and isopropyl palmitate.

13. The fabric softening composition according to claim 1, wherein the plasticizer comprises isodecyl alcohol and ethylhexyl isononanoate.

14. A method of forming a fabric softening composition according to claim 1, comprising the steps of:

heating about 80 wt. % to about 95 wt. % of a dialkyl ester of triethanol ammonium methyl sulphate to approximately 70-85° C.;

heating about 1 wt. % to about 10 wt. % of an edible-type tallow to about 40-50° C.;

mixing the edible-type tallow and dialkyl ester of triethanol ammonium methyl sulphate to form a first mixture;

adding at least one plasticizer comprising a compound having an iso-methyl group and from about 0.5 wt. % to about 5 wt. % of isopropyl alcohol to he first mixture and stirring until homogeneous to form a second mixture; and heating the second mixture to about 50-60° C. and maintaining the second mixture at that temperature for about one day.

* * * * *